US009487339B2

(12) United States Patent
Defemme et al.

(10) Patent No.: US 9,487,339 B2
(45) Date of Patent: Nov. 8, 2016

(54) LIQUID DISPENSING HEAD, IN PARTICULAR FOR A BOTTLE FOR PACKAGING A LIQUID TO BE DISPENSED DROP BY DROP

(71) Applicant: LABORATOIRES THEA, Clermont-Ferrand (FR)

(72) Inventors: Alain Defemme, Chamalieres (FR); Fabrice Mercier, Clermont-Ferrand (FR)

(73) Assignee: Laboratories Thea, Clermont-Ferrand (FR)

( * ) Notice: Subject to any disclaimer, the term of this patent is extended or adjusted under 35 U.S.C. 154(b) by 0 days.

(21) Appl. No.: 14/420,191

(22) PCT Filed: Aug. 6, 2013

(86) PCT No.: PCT/IB2013/001728

§ 371 (c)(1),
(2) Date: Feb. 6, 2015

(87) PCT Pub. No.: WO2014/024029

PCT Pub. Date: Feb. 13, 2014

(65) Prior Publication Data

US 2015/0284173 A1 Oct. 8, 2015

(30) Foreign Application Priority Data

Aug. 6, 2012 (FR) ..... 12 02192

(51) Int. Cl.
*B65D 83/00* (2006.01)
*B65D 47/18* (2006.01)
*A61J 1/06* (2006.01)

(52) U.S. Cl.
CPC ..... *B65D 83/0094* (2013.01); *A61J 1/065* (2013.01); *A61J 1/145* (2015.05); *A61J 1/1456* (2015.05);*B65D 47/18* (2013.01); *A61J 1/1418* (2015.05); *A61J 1/1481* (2015.05); *A61J 1/2075* (2015.05); *A61J 1/2082* (2015.05); *A61J 1/2086* (2015.05)

(58) Field of Classification Search
CPC . B65D 83/0094; B65D 47/18; A61J 1/1456; A61J 1/145; A61J 1/065; A61J 1/1418; A61J 1/1481; A61J 1/2082; A61J 1/2075; A61J 1/2086
USPC ..... 222/420, 92, 189.09, 189.06; 210/321.89, 321.9
See application file for complete search history.

(56) References Cited

U.S. PATENT DOCUMENTS 5,105,993 A 4/1992 La Haye et al.
5,681,463 A * 10/1997 Shimizu ..... B01D 61/18 210/266
7,604,737 B2 * 10/2009 Francisco ..... B01D 61/145 210/232
2005/0035041 A1 * 2/2005 Nohren, Jr. ..... A45F 3/16 210/209

OTHER PUBLICATIONS

International Search Report for PCT/IB2013/001728 dated Dec. 2, 2013.

* cited by examiner

*Primary Examiner* — Donnell Long
(74) *Attorney, Agent, or Firm* — Millen White Zelano & Branigan, P.C.

(57) ABSTRACT

The invention concerns a liquid dispenser head which is designed to be mounted on a bottle containing a liquid and comprises a filtering device (26) forming an interface between the inside and the outside of the bottle. The filtering device comprises tubular filters (30) which are extended longitudinally so they can be plunged into the bottle, particularly tubular filters whose wall consists of a membrane that is selectively permeable to a liquid to be expelled from the bottle and made of hydrophilic material for this purpose. So that the expelled liquid can be replaced by air, the membrane forming the wall of said filter tube is made of hydrophobic material so as to be selectively air-permeable. The hydrophobic membrane also filters bacteria in the air.

25 Claims, 2 Drawing Sheets

LIQUID DISPENSING HEAD, IN PARTICULAR FOR A BOTTLE FOR PACKAGING A LIQUID TO BE DISPENSED DROP BY DROP

This invention concerns a dispenser head that dispenses liquid from a bottle on which it is mounted. Although it particularly concerns the design of liquid dropper bottles for the pharmaceutical industry, it also concerns the design of said bottles for cosmetics and hygiene products and, more generally speaking, for any industry with similar needs in the field of liquid dispensing.

Liquid dispenser heads already exist that have selective permeability membranes placed inside a mounting unit in the neck of a bottle containing liquid to be dispensed, across the path of the expelled liquid and that of the aspirated replacement air. Depending on their filtration capacities and their physicochemical properties, which determine their semi-permeability properties, these membranes can play several roles. Thus a membrane with similar properties to those of a filter with a mesh size of less than 0.2 microns will operate as a bacteria filtering membrane protecting the content remaining in the bottle from the microbial contamination of outside air brought into the bottle. Thus, a membrane made of hydrophilic material will tend to remain impregnated with an aqueous liquid which has passed through it during the expulsion of a drop and, as a result, will become not permeable to air, while air will easily pass through a membrane made of hydrophobic material until a pressure equilibrium is achieved between the two sides of the membrane.

The most complete solution, as marketed in the applicant's products, consists in using membranes which have all these functions at the same time. Situated at the base of a dropper tip mounted on the liquid reservoir of the bottle, they form the interface between the internal volume of the bottle and the outside air. They are designed to be partly hydrophilic and partly hydrophobic. In practice, the membrane is a bacteria filtering membrane made of hydrophilic material in some places (so as to be impregnated by aqueous solutions and let them pass through) and hydrophobic material in other places.

The invention is aimed at offering an alternative to the classical designs of the past by proposing dispenser heads in which the design and layout of the semi-permeable membrane are modified in order to improve the management of fluid exchange between the inside and outside of the bottle based on the difference in pressure between the two sides. It also aims at increasing the application possibilities, especially in the preferred embodiments of the invention, for the dispensing of viscous solutions that are preserved in a sterile state.

For this purpose, the principle of the invention consists in placing a semi-permeable membrane in the longitudinal direction of the bottle rather than in the crosswise direction as adopted until the present. At the same time, the interface between the liquid and the air, at least for what relates to the membrane which is selectively permeable to water (and more generally speaking, to the liquid to be dispensed out) in the presence of air, is established by configuring the membrane around one or several ducts that communicate with the outside and are plunging into the bottle.

In practice, flexible tubes are used whose walls are made of membrane material and whose ends emerge outside the bottle, advantageously through a perforated plate that is used to mount the assembly over the neck of the bottle containing the liquid to be dispensed, thereby encasing their respective ends and maintaining the tubes with their mouth open by individual outlet orifices while stiffening their walls and ensuring airtightness.

To facilitate manufacture and improve wear resistance, the practical solution currently retained is to use tubes of sufficient length for them to be bent into a U-shape so that they can communicate with the outside via their two opposite ends. Each of the said tubes thus provides two ducts for communication between the inside of the bottle and the outside atmosphere via the interface membrane.

In connection with the above construction features, it can be considered that the membrane which manages the alternate flows through the dispenser head according to the pressure exerted on either side is configured in the form of tubular filters with selective permeability properties which operate either by extracting liquid from the bottle and expelling it outside the bottle or by bringing outside air into the bottle to compensate for the expelled liquid.

Whatever the case, the dispenser head according to the invention, with the longitudinal arrangement of its tubular filters, provides a large, active, selectively permeable surface which is no longer bound by the dimensional limits imposed on current bottles by the diameter of the neck of the bottle over which the membrane is placed. This unique feature is particularly important for the extraction of liquids whereas the particle filtration capacity is more especially required for the active membrane surface active during air intake.

In particular, a bacteria filtering membrane will play a protective role in the presence of a liquid that must remain sterile in the bottle, in which case there is no need for the liquid to contain preservatives. It is well known that the presence of preservatives in the composition of the product to be dispensed can lead to side effects, such as irritation of the mucous membrane in the case of eye drops, or in the case of other sensitive parts of the body, in dermatology in particular.

Increasing the liquid-permeable active filtering surface reduces the pressure that must be exerted on the walls to expel the liquid due to the greater functional surface area. It also facilitates the use of liquids consisting of viscous solutions in the dispenser bottle.

Another advantage lies in the fact that there is greater freedom in relation to the size and location of the hydrophilic and hydrophobic areas of the membrane. Although it is possible to envisage hydrophilic areas and hydrophobic areas on the same tube, it appears to be simpler in terms of manufacture and generally more effective to make some tubes hydrophilic (for the purposes of liquid extraction) and others hydrophobic (for the purposes of air intake). As a result, mixing of the liquid and gas phases cannot occur.

Here it is considered that the filter tube is not necessarily U-shaped. Tubes with closed ends can also be used with only one end outside the liquid conditioning bottle.

In a particularly advantageous construction method, the filtration unit has antibacterial properties and some of the filter surfaces are hydrophilic and reserved for liquid extraction while other filter surfaces are hydrophobic and reserved for air intake. So that the air will not go back into the bottle before the liquid has been expelled when the bottle is upturned to dispense drops, it is generally preferable to position the hydrophobic surfaces next to the perforated porous disk plate used to mount the assembly that closes the axial passage of the annular body of the dispenser head that is common to both the liquid and the air and to place the hydrophilic surfaces further down in the liquid conditioning bottle. The hydrophobic surfaces are thus immersed in the liquid when the bottle is upturned, which prevents air from entering.

In practice, the solutions thus implemented according to the invention have the advantage of separately regulating the surface areas reserved for liquid extraction and those reserved for air intake, as well as determining their respective locations at various depths inside the bottle and at various distances from the neck of the bottle. Also, when the liquid expulsion ducts are separate from the air intake ducts (herein also called tubes), there is no risk of mixing the liquid and gas phases during said operations, which is particularly useful when, due to the nature of the active ingredient or the presence of a surfactant in its composition, the liquid to be dispensed could cause foaming when it comes into contact with the air.

Separating the different functions of the tubular filters and their unrestricted positioning in the bottle can be combined advantageously for applications using foaming products. When the physical separation between the air passage and the liquid passage allows for individual regulation of the flow rate of the two fluids, there is no longer any need for the porous flow regulation plug generally present on dropper bottles, in which the bi-functional membrane, that is, having both hydrophilic and hydrophobic properties, is placed flat across the top of the bottle. In this case, the bottles according to the invention become particularly advantageous for the dispensing of foaming products because the porous plug itself is foam-producing in this case. It is also particularly interesting in the case of foaming products to locate the surfaces of the air-permeable membrane tubes at the top of the bottle, next to the stopper that closes the neck, and reserve for the extraction of liquid the surfaces of the membrane tubes that are plunging inside the bottle, possibly such that they be immersed in the liquid reserve present in the bottle.

For its part, protection of the liquid from the penetration of bacterial contamination is of excellent quality. Only the ends of the tubes emerge on the surface of the plug, where they are open so that the liquid can be expelled. The surface area of liquid exposed to the outside environment is therefore extremely small. Also, the liquid which has passed through the membrane and remains in the tubes is confined in thin columns thus preventing the dissemination of tiny pockets of contaminated liquid and any resulting bacterial proliferation.

During actual construction of the liquid dispenser heads according to the invention, it is nevertheless preferable to close the assembly, above the mouth of the tubes, with a diffusing stopper that distributes the liquid taken from the bottle in the form of drops at the time of expulsion. Said plug, constructed of a porous material for this purpose, also prevents atmospheric dust from reaching the mouth of the tubular filters.

According to a secondary characteristic of the invention, it is advantageous to group the different tubular elements of hydrophilic membrane together into a series of parallel elongated tube ducts extending along the axis of the bottle, with the bundle they thus form being encased in a sheath designed to keep them together in the longitudinal direction of the bottle, thus improving the functionality of the membrane. The presence of said sheath, which is highly resistant, also has the advantage of facilitating mounting of the assembly when it is inserted downwards through the neck of the bottle.

Insofar as the sheath encasing the membrane tubes consists of a non-perforated tubular wall, it also serves to guide the flow of the liquid which, during the expulsion of drops, is pushed through the sheath, so that the liquid licks the walls of the membrane tubes, passing around them without turbulence.

In relation to the mechanical construction and mounting of the assembly, the sheath can be advantageously given an outside configuration that will facilitate airtight contact with the neck of the bottle.

Other details concerning the sheath are designed to use up all the liquid in the bottle.

From this purpose, a window can be advantageously made in the tubular wall of the sheath just below the base of the terminal dropper tip to allow the liquid to pass inside the sheath when there is only a small amount left in the bottle and the liquid collects outside the sheath in the upturned bottle. Whatever the case, said window can be used to aspirate air sucked into the bottle when the pressure is released on the walls of the bottle after it is turned upright following expulsion of a drop of liquid.

However, as illustrated in the appended figure, an air intake membrane tube is placed advantageously above said window to form a coil around the axis of the bottle and outside the sheath encasing the tubular filters reserved for liquid expulsion.

BRIEF DESCRIPTION OF DRAWINGS

The invention will now be more completely described in relation to its preferred characteristics and their advantages, referring to FIGS. 1 to 3 which illustrate the main elements of a liquid dispenser head mounted on a bottle containing an eye drop solution. Among these figures.

The invention will be described in accordance with these figures, and it is understood that the characteristics of each of the construction methods can be combined to obtain a dispenser head according to the invention, designed to be mounted on a liquid reservoir bottle and comprising a filtering device placed in the neck of the bottle to provide an interface between the inside and outside of the bottle, along the same path taken alternately by the liquid during expulsion and by the outside air during aspiration.

Figure 1:
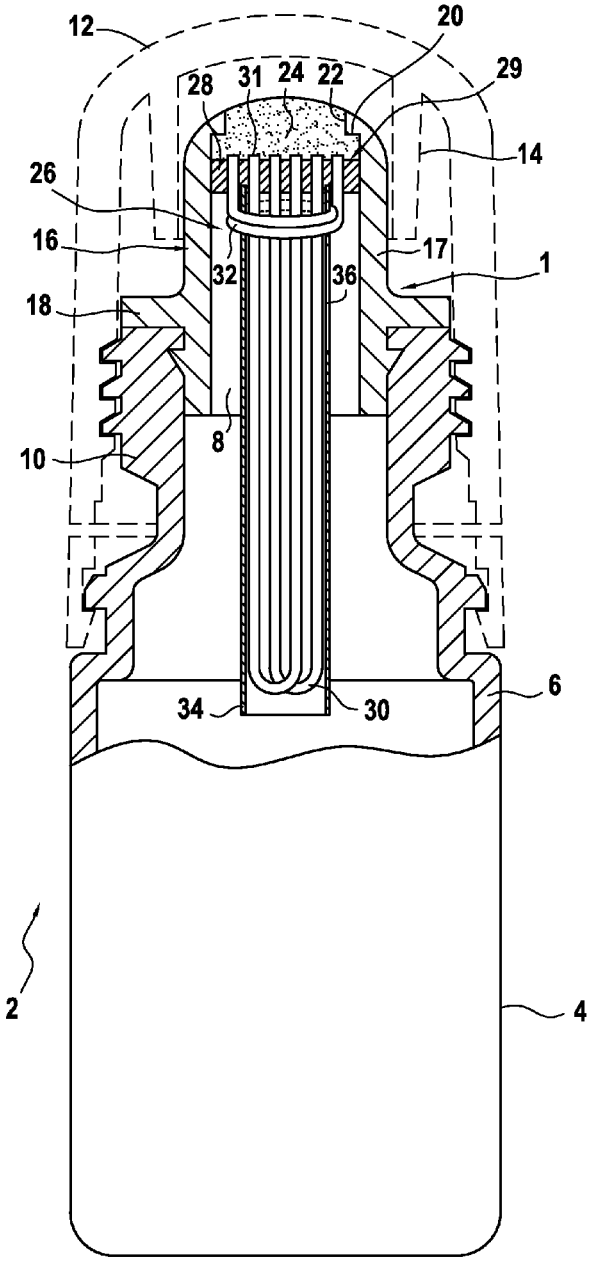
FIG. 1, in a partial cross-section, shows a bottle thus equipped according to a first construction method.

A dispenser head 1 according to the first construction method of the invention is illustrated in FIG. 1, mounted on a liquid reservoir bottle or liquid conditioning bottle 2. Generally speaking, the elements comprising the bottle, and particularly the dispenser head, are made of a plastic material compatible with the preservation of an ophthalmic solution. In particular, they are all made of polymer from the polyolefin family and polyethylene in particular.

The bottle has a liquid storage reservoir 4 whose cylindrical peripheral wall 6 is elastically and reversibly deformable in order to dispense the liquid through manual compression of said wall by the user, and which spontaneously returns to its initial shape due to the intake of air to compensate for the liquid expelled when said manual compression ceases. The incoming air follows the reverse path taken by each outgoing drop of liquid through the dispenser head, in this case passing through cylindrical bore 8 inside the body of the dispenser head, which is annular in shape.

The cylindrical wall of the bottle has a narrower part at the free end which is axially extended by a neck 10, in which the dispenser head is fixed in an airtight connection.

A removable cap 12 which closes the dispenser head is screwed to the neck of the bottle in the usual way. The cap consists of a hollow cylinder closed at one end with a concentric shaft 14 inside the cylinder.

The dispenser head forms a dropper 16, terminating its cylindrical annular body 17 outside the bottle. The body 17 has a flange 18 which extends radially towards the outside of the cylindrical wall. At the end of the dropper which is designed to face in the opposite direction to the inside reservoir of the bottle, and through which the liquid leaves the bottle, a narrower part is produced by a shoulder 20 to form an outlet 22 of smaller diameter and a shoulder inside the dropper.

A porous stopper 24 is placed at the end of the dropper against said shoulder, filling the entire passageway. The stopper is made of a polyethylene-based thermoplastic material which makes it hydrophobic, thus preventing the stagnation of any liquid and allowing air to enter when the stopper dries. It is obtained by sintering, that is, by the heat treatment of thermoplastic particles and can contain a bactericide, comprising, for example, silver ions known for their efficacy in relation to numerous bacterial strains present on the skin and ocular mucous membranes. The porous stopper has the porosity characteristics required to distribute the liquid leaving the bottle without notably reducing its circulation in order to form a drop during expulsion. The diameter of the final outlet can be modified to determine the size of the drop.

A filtering device with a semi-permeable membrane 26 is placed inside the dispenser head. It comprises a set of tubular filters, some of which have a hydrophobic semi-permeable wall while others have a hydrophilic semi-permeable wall, and an organic disk plate made of resin moulded over the mouth of the tubular filters, which is used to mount the assembly across the dropper 17 forming the body of the liquid dispenser head. The disk plate 28 is placed across the dropper, in airtight contact with the inside of the latter around its entire circumference while the tubular filters are designed to be plunged into the liquid conditioning bottle.

Figure 2:
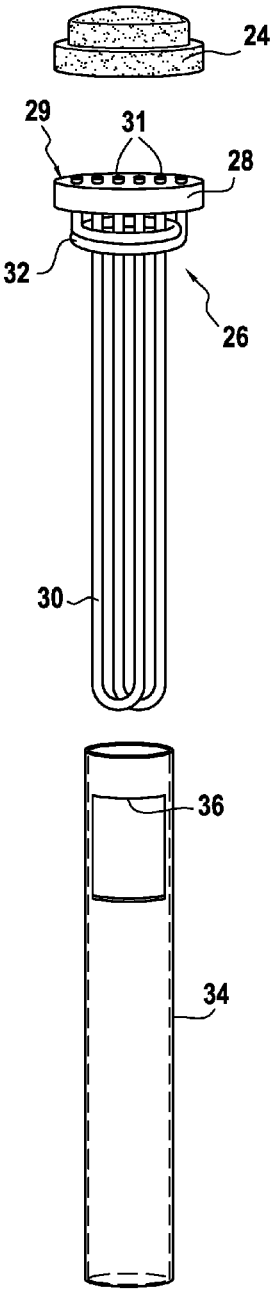
FIG. 2 shows an exploded view of the elements comprising the bottle illustrated in FIG. 1, particularly a sheath, tubular filters and plug.

As illustrated in FIGS. 1 and 2, the filter tube assembly consists of tubes 30 bent into a U-shape and an additional filter tube 32 coiled around the U-shaped tubular filters. The U-shaped tubular filters extend longitudinally into the bottle at a greater distance from the disk than the filter coil, while the latter is closer to the disk plate, and out of reach of the liquid when the bottle is placed in the upright position.

Each filter tube has a semi-permeable membrane wall. Here, the filter coil 32 consists of a hydrophobic semi-permeable membrane which is therefore selectively permeable to air and not to liquid, while the tubular filters extending longitudinally into the bottle consist of a hydrophilic membrane so that they are selectively permeable to liquid in the presence of air.

As described above, each of the filters is a semi-permeable tube open at both ends 31, with said ends passing through the disk plate 28 and visible on the upper side 29 of the disk plate which is covered with a stopper 24, on the opposite side to reservoir 4. It can therefore be observed that all the open ends 31 of the tubular filters 30, 32 in the filtering device are on the same side of the disk plate 28, that is, on the side of the outlet canal, and that the tubular filters do not have any open ends on the reservoir side.

According to an advantageous characteristic of the filtering device in the invention, the porosity or pore size of the membrane comprising the wall of the tubular filters, which determines the particle filtering capacity, can be different depending on whether the tubes have hydrophobic walls and are reserved for air intake or have hydrophilic walls and are reserved for liquid expulsion. Thus, while a bacterial filtering capacity of 0.2 microns is maintained for the air-intake membrane in order to preserve a sterile environment inside the bottle, the liquid-expulsion membrane can have a coarser filtering capacity.

The main advantage is to be able to use the bottle for viscous ophthalmic solutions without having to unduly increase the pressure to be exerted on the bottle to force the liquid through the hydrophilic membrane, which also depends on the liquid semi-permeable surface area available. The acceptable viscosity can be determined according to the capacity of the liquid-impregnated membrane to become air-impermeable so that, without having to be fine enough to filter bacteria, it will still prevent contaminating micro-organisms in the outside air from getting through, on the assumption that they get that far. In the filtering device assembly, the porous stopper 24 helps to protect the sterile contents of the bottle due to its ability to filter dust and similar particles present in the outside air, which it prevents from entering the tubular filters, along with any contaminating micro-organisms it may contain. The same stopper prevents any direct contact between the skin and mucous membranes of the user and the disk plate 28 where the tubes emerge. Overall, good air filtration is provided so that the bottle can be used for a preservative-free ophthalmic solution.

A sheath 34 extends inside the liquid conditioning bottle and perpendicular to the disk plate, where it has a hollow inside diameter designed to correctly insert the longitudinal tubular filters. The sheath also provides a support for the filter coil.

The sheath is open at both of its longitudinal ends. At one end, it is made integral with the perforated disk plate 28 that serves as a support for all the tubular filters, during manufacture for example, when the resinous disk plate is moulded over the tubes. The sheath has a window 26 in its wall through which liquid can pass, near the end designed to be in contact with the resinous disk plate. It is made of rigid plastic to protect the tubular filters placed inside and to guide the liquid that enters the sheath through its open end and the window.

As illustrated, the filters and sheath are arranged so that the hydrophobic filter tube 32 is located between the disk plate and the window of the sheath. The advantage of this arrangement is mainly to prevent too much liquid remaining in the bottle and not being expelled when the bottle is nearly empty.

We are now going to describe assembly of the dispenser head and the bottle, the dispenser head being made separately from the bottle which is produced continuously.

To mount the dispenser head, the stopper 24 is first inserted into the body of the dropper, by pushing it from the largest diameter end until it is up against the shoulder 20 at the opposite end. Once in position, the domed part of the stopper is flush with the domed end of the body of the dropper. The assembly already formed by the perforated disk plate used to mount the tubular filters, together with the tubular filters and the guide sheath, is forced into the dropper so that the disk plate is in contact with the porous plug.

The liquid conditioning bottle is then mounted by inserting the dispenser head into the neck of the bottle after filling the reservoir with liquid. The dispenser head is mounted by first inserting the sheath into the bottle until the dropper flange comes up against the upper end of the bottle neck 38. The dispenser head is then irreversibly clipped into the neck of the bottle by cooperation of the right-angled lips which project from the circular wall of the dropper and the corresponding grooves inside the neck of the bottle.

It should be noted that mounting of the dispenser head as described above has a twofold advantage: first, the elements are mounted simply by insertion and second, there is no risk of damaging the longitudinal tubes during the insertion process because they are protected by the sheath in which they are encased.

The use of said dispenser head and associated liquid conditioning bottle for drop-by-drop delivery of an ophthalmic solution will now be described.

The user upturns the bottle and places it above the eye, pressing the wall of the bottle manually so as to deform it elastically and reversibly by compressing the inside space. The liquid in the reservoir is pressed up against the membrane wall of the tubular filters, whether they are hydrophilic or hydrophobic, but only the surfaces of the hydrophilic membrane allow the liquid to pass through. The tubular filters are impregnated due to the difference in pressure on either side of the membrane, thus preventing any air from entering. The liquid inside the hydrophilic filter tube passes through the tube to the stopper via the perforated disk plate which closes off the internal space of the annular dropper. The liquid thus begins to pass from the reservoir to the outside of the bottle via the membrane because it is held inside the neck of the bottle by the disk plate which is impermeable to liquid and air in the areas in which there are no tubular filters. At the same time, when the bottle is upturned to dispense an eye drop, the liquid covers the hydrophobic membrane filter tube, which in the present case is coiled around the sheath next to the disk plate mounted across the dropper. Immersion of the hydrophobic membrane prevents air from leaving the reservoir so that the liquid is forced to leave by other routes. The pressure resulting from deformation of the reservoir wall prevents air from entering the reservoir to compensate for the expelled liquid.

The pressure to be exerted on the walls of the bottle to expel the liquid is not as great as in prior art bottles because the exchange surface provided by the longitudinal arrangement of the membranes is greater than it was previously in the case of a transverse membrane. A sufficient flow rate of the liquid is ensured by the diameter and number of tubular filters forming a hydrophilic passageway approximately in the centre of the disk plate placed across the air and liquid passageway. The liquid passes beyond the disk and through the end stopper which ensures that it is dispensed in the form of drops.

When the number of drops required has been dispensed, the user releases the pressure on the wall of the bottle and turns it to its normal upright position. While the wall of the bottle is resuming to its initial cylindrical shape, the liquid is drawn back inside the bottle thereby escaping from the hydrophobic membrane and the air can then freely enter the bottle until the pressure between the two sides of the filter assembly is balanced. Throughout the operation, the hydrophilic membrane remains impregnated with liquid and impermeable to air, while the terminal stopper dries easily.

When then the cap 12 of the liquid dispenser head according to the invention is put back on the dropper tip, the airtightness of the assembly with the shaft 14 which is radially pressed up against the outside surface of the stopper leads to slight excess pressure on the end stopper inside the cap. The porous stopper remains dry and the membrane tubes retain their specific properties, with the hydrophilic and hydrophobic surfaces being clearly distinct and physically separate. The bottle is thus ready to be used again.

Man will understand that for correct operation of the bottle and particularly for correct expulsion of the liquid and the intake of air to compensate for the expelled liquid, the hydrophobic surfaces should be placed close to the disk, at the top of the bottle when it is upright, while the hydrophilic surfaces extend longitudinally further into the liquid reservoir than the hydrophobic surfaces.

First, the longitudinal component of the hydrophilic surfaces, which is inserted more deeply into the reservoir, provides a larger exchange surface to ensure that a larger volume of liquid is expelled from the reservoir, so that the pressure to be exerted to expel a given volume of liquid can be reduced if the number of tubular filters and the diameter of the tubular ducts inside them are sufficient to ensure correct flow of the liquid. The immersion of the hydrophilic filters in the bottle also means that they will be impregnated quickly and prevent air from entering via the filters. Even when the bottle is nearly empty, when all the liquid is piled up against the transverse stopper and the end of the tubular filters opposite the stopper is no longer immersed in liquid, the hydrophilic portion will remain moist and thus impermeable to air. Secondly, the fact that the hydrophobic surfaces along the entire length of the corresponding tubular filters are next to the transverse disk plate means that when the bottle is upturned for use, the liquid covers and envelops the hydrophobic filter. The result is a bottle in which the remaining amount of unused liquid is extremely small. When, after the bottle has been used a large number of times, upturning it no longer bathes the hydrophobic filter with liquid because all the liquid is now between the stopper and the hydrophobic filter, the air present in the reservoir can be expelled and the remaining liquid is trapped in the bottle and lost.

It must therefore be ensured that the hydrophobic surfaces are close to the stopper closing the neck of the bottle so that they are between the stopper and the window in the wall of the sheath. The window allows liquid to pass inside the sheath when there is only a small amount of liquid left in the bottle and the liquid collects outside the sheath inside the upturned bottle. Thus the small amount of lost liquid stagnating against the plug, which is not drained by the hydrophilic filters, will impregnate the hydrophobic filters to prevent air from escaping and ensure that the bottle functions correctly until the level of liquid is insufficient for the hydrophobic filters to be completely immersed.

Figure 3:
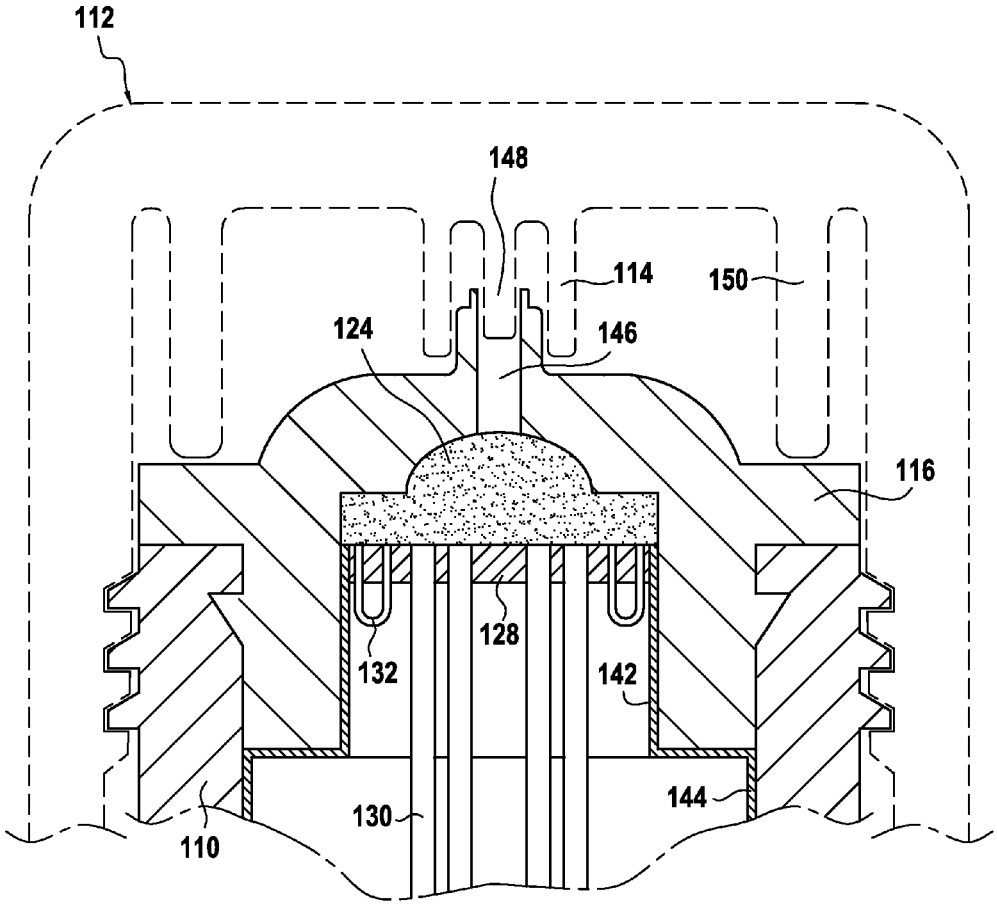
FIG. 3 shows a cross-section of a bottle equipped with a drop dispenser head according to a second construction method.

A second construction method will now be described, illustrated diagrammatically in FIG. 3. The diagram of the dispenser head has been intentionally enlarged to clearly show the arrangement of the elements in relation to each other, which means that the proportions have not always been respected, for example, between the width of the tubular filters and the thickness of the walls of the bottle or between the height and width of the dropper.

The selectively air-permeable hydrophobic membrane tubular filters 132 are U-shaped, like the hydrophilic membrane tubular filters 130 reserved for liquid expulsion. They are of similar dimension, in the order of one millimetre, but of much shorter length. As a result, the hydrophobic functional membrane surface is very close to the filter mounting disk plate at the top of the bottle, as in the previous construction method.

The second construction method also differs in that the sheath encasing the tubes or its equivalent is not of constant diameter. In relation to the porous stopper 124 covering the assembly, the closest portion 142 is located next to dropper 116 while the farthest portion 144 is located inside the bottle. The closest portion is of smaller diameter and completely fills the inside diameter of the dropper while the farthest portion is of greater diameter so that it will come into contact with the wall of the neck of the bottle 110 before plunging into the liquid reservoir. This facilitates airtightness during mounting of the bottle.

It can also be observed that there is no longer an annular space around the sheath in the body of the dropper and the liquid can no longer be trapped there. However, a window can be made in the sheath further along the inside of the bottle, after the neck. Furthermore, the hydrophobic tubular filters 132 for air intake are no longer separated from the hydrophilic tubular filters by the sheath. However, it can be observed that, as in the first construction method, a hydrophobic filtration area is thus delimited on the transverse disk plate 128 surrounding the hydrophilic filtration area on said disk. As in the previous case, the same perforated disk plate has been chosen here to support both the hydrophilic and hydrophobic tubes.

The second construction method also differs from the first in that the dropper leads to an outlet canal 116 in the dropper whose aim is to facilitate the formation and correct sizing of the drops. The dropper could be made of flexible material which is deformed elastically to let the drop pass around the liquid dispensing stopper and into the outlet canal 146.

In this configuration, the removable cap 112 is shaped so as to stopper the end of the outlet canal when the cap is screwed in place. The cap consists of a hollow cylinder closed at one end and comprising a central pin 148 inside the cylinder that projects from the radial end wall. The cap also has two longer concentric pins 114 and 150 between the central pin and the peripheral side wall. The central pin is designed to cooperate with the outlet canal of the dropper to close it, while the longer pins are designed to be supported by the outside surfaces of the dropper, one supported radially by the circumference of the body and the other axially by the flange.

Based on these two construction methods, given by way of example, the description above clearly explains how the invention is able to achieve its objectives. In particular, it uses tubular filters to form a selectively-permeable membrane which offers a greater exchange surface for the liquid and air that pass through the interface between the liquid conditioning bottle and the outside air. It also allows simplified construction of two distinctly hydrophilic and hydrophobic areas to ensure the alternative passage of air and liquid necessary for correct operation of the bottle. The range of use of the dispenser head according to the invention can thus be increased by diversifying the viscosity of the liquid inserted into the bottle associated with said dispenser head. First, having a larger exchange surface means that the pressure required to compress the wall of the reservoir can be reduced for a given liquid to be expelled. By extension, it allows for the use of more viscous liquids which are naturally more difficult to expel, while exerting the same pressure as for previous bottles. Second, by facilitating the use of distinctive hydrophilic and hydrophobic portions, different filtering sizes can be used, for example. This enables the bacterial filtration capacity of the functional hydrophobic membrane to be maintained for example when drawing in outside air while providing a smaller microorganism filtration capacity for the hydrophilic membrane tubes in order to facilitate the expulsion of more viscous liquids.

It is clear from the above that the invention is not limited to the construction methods specifically described and illustrated in the figures. On the contrary, it can be extended to any variant using equivalent means.

The invention claimed is:

1. Liquid dispenser head comprising:

a filtering device (26) with a semi-permeable interface membrane managing liquid expulsion and air intake at the interface between the inside and outside of a liquid conditioning bottle, wherein said interface membrane in said filtering device comprises hydrophilic tubular filters for liquid expulsion having the walls made of a membrane material selectively permeable to liquid in the presence of air, said hydrophilic tubular filters extending longitudinally in the bottle from a transverse disk plate (28) mounted across said head through which they emerge outside the bottle, and wherein said interface membrane further comprises a hydrophobic membrane surface that is selectively permeable to air in the presence of liquid and is constructed and arranged aside said hydrophilic tubular filters in the vicinity of said plate so as to filter contaminants from outside air drawn into the bottle via an outside orifice to compensate for liquid having been expelled out through said orifice.

2. Dispenser head according to claim 1, comprising at least one hydrophobic tubular filter for air intake having walls made of a hydrophobic membrane material selectively permeable to air in the presence of liquid that form said hydrophobic membrane surface, and wherein said at least one hydrophobic tubular filter for air intake emerges through same said transverse disk plate as said hydrophilic tubular filters for liquid expulsion.

3. Dispenser head according to claim 2, wherein the walls of said at least one hydrophobic tubular filter for air intake and said hydrophilic tubular filters for liquid expulsion show a particle filtering capacity which is finer for the hydrophobic tubular filter wall and coarser for the hydrophilic tubular filter.

4. Dispenser head according to claim 3 wherein the walls of said at least one hydrophobic tubular filter are made of a selectively air-permeable bacteria filtering membrane.

5. Dispenser head according to claim 2, further comprising a protective porous stopper covering said transverse disk plate (28) over all mouths of said hydrophilic tubular fillers and said at least one hydrophobic tubular filter emerging therethrough out of said bottle.

6. Dispenser head according to claim 2, wherein said at least one hydrophobic tubular filter for air intake is coiled in the vicinity of said transverse disk plate around a bundle of said hydrophilic tubular filters for liquid expulsion extending longitudinally therefrom.

7. Dispenser head according to claim 1, wherein the tubular filters for liquid expulsion are bended in U-shape and that both end mouths (31) of each of said hydrophilic tubular filters being embedded in said transverse disk plate, whereby the internal ducts in said hydrophilic tubular filters emerge on an upper side (29) of said transverse disk plate and communicate there with outside the bottle.

8. Dispenser head according to claim 7, comprising hydrophobic tubular filters for air intake having walls made of a hydrophobic membrane material selectively permeable to air in the presence of liquid that form said hydrophobic membrane surface, said hydrophobic tubular filters being disposed surrounding a bundle of said hydrophilic tubular filters in the vicinity of said transverse disk plate.

9. Dispenser head according to claim 8, wherein said hydrophobic tubular filters extend a length from said transverse disk plate which is shorter compared to said hydrophilic tubular filters extending longitudinally into the bottle.

10. Dispenser head according to claim 8, wherein said hydrophobic tubular filters for air intake as well as said hydrophilic tubular filters for liquid expulsion are bended in U-shape with both end mouths being embedded in said transverse disk plate, whereby internal ducts in said either hydrophobic or hydrophilic tubular filters emerge on an upper side of said transverse disk plate and communicate there with outside the bottle.

11. Liquid dispenser head comprising a filtering device with a semi-permeable interface membrane managing liquid expulsion and air intake at an interface between inside and outside a liquid conditioning bottle, wherein said interface membrane in said filtering device comprises a bundle of hydrophilic tubular filters for liquid expulsion having walls made of a membrane material selectively permeable to liquid in the presence of air, said hydrophilic tubular filters extending in a bottle longitudinal direction from a transverse disk plate mounted across said head through which they emerge outside the bottle on an upper side of said transverse disk plate, wherein said liquid dispenser head further comprises a non-perforated guide sheath encasing said bundle of hydrophilic membrane tubular lifters, and wherein said interface membrane in said filtering device further comprises a hydrophobic membrane surface that is selectively permeable to air in the presence of liquid and is formed into at least one hydrophobic tubular filter for air intake which is coiled around outside said sheath in the vicinity of said transverse disk plate and has end mouths emerging out through said transverse disk plate on said upper side thereof.

12. Dispenser head according to claim 11, wherein said sheath (34) has a window (36) for the liquid to pass through its tubular wall onto the longitudinally extending hydrophilic tubular filters for liquid expulsion when the dispenser head is upturned, said window being placed in proximity to said disk plate (28).

13. Dispenser head according to claim 12, wherein said at east one hydrophobic tubular filter (32) for air intake coiled around outside said sheath is located between the transverse disk plate (28) and said window (36) through said sheath.

14. Dispenser head according to claim 11, further comprising a protective porous stopper covering said transverse disk plate over all mouths of said hydrophilic tubular filters and said at least one hydrophobic tubular filter emerging out through said transverse disk plate.

15. Dispenser head according to claim 11, further comprising an annular dropper body for airtight connection onto a neck of a liquid containing bottle and wherein said at least one hydrophobic tubular filter for air-intake is located in said dropper body while said hydrophilic tubular filters for liquid expulsion for liquid extend longitudinally further into said bottle.

16. Dispenser head according to claim 15, wherein said dropper body terminates into a dropper tip outside said bottle for expelling liquid out of said bottle through said filtering device and further comprising a removable cap for air-tightly closing said dropper tip off.

17. Liquid dispenser head comprising:

a filtering device with a semi-permeable interface membrane managing liquid expulsion and air intake at an interface between inside and outside a liquid conditioning bottle, wherein said interface membrane in said filtering device comprises a bundle of hydrophilic tubular filters for liquid expulsion having walls made of a membrane material selectively permeable to liquid in the presence of air, said hydrophilic tubular filters extending in a bottle longitudinal direction from a transverse disk plate mounted across said head through which the emerge out on an upper side of said transverse disk plate, wherein said interface membrane in said filtering device further comprises a hydrophobic membrane surface that is selectively permeable to air in the presence of liquid and is formed into several hydrophobic tubular filters for air intake that are placed around said bundle and have end mouths emerging out through said transverse disk plate on said upper side thereof, and wherein said hydrophobic tubular filters for air intake extend in said longitudinal direction along a longitudinal height less than that of the hydrophilic membrane filters for liquid expulsion.

18. Dispenser head according to claim 17, further comprising a protective porous stopper covering said transverse disk plate over all mouths of said hydrophilic tubular filters and said hydrophobic tubular filters emerging out through said transverse disk plate.

19. Dispenser head according to claim 18, wherein said hydrophilic tubular filters and said hydrophobic tubular filters are supported by said transverse disk plate, wherein said transverse disk plate is mounted across a dropper for airtight connection to a liquid conditioning bottle and wherein said dropper annular body terminates into a dropper tip outside said bottle for alternate liquid expulsion and air intake through said orifice.

20. Dispenser head according to claim 19, further comprising a removable cap for airtightly closing said orifice off.

21. Dispenser head according to claim 19, wherein said hydrophilic tubular filters for liquid expulsion are designed to extend longitudinally plunging into the liquid conditioning bottle.

22. A bottle for conditioning a liquid in a sterile state, comprising: a peripheral wall which is elastically and reversibly deformable for dispensing a liquid out of said bottle due to manual compression of said wall and which returns spontaneously to its initial shape due to air intake from outside the bottle compensating for the liquid dispensed out when said manual compression is released, a dispenser head having an annular body for tight connection in a neck of said bottle and a terminal dropper tip with an outside orifice for liquid expulsion and alternate air intake, a filtering device with a semi-permeable interface membrane for ensuring alternative passage of air and liquid through said dropper tip and managing liquid flow and air flow between inside and outside the bottle based on a difference in pressure between either sides of said interface membrane, wherein said interface membrane in said filtering device comprises hydrophilic tubular filters for liquid expulsion having walls made of a membrane material selectively permeable to liquid in the presence of air, said hydrophilic tubular filters extending longitudinally into the bottle from a transverse disk plate mounted across said head through which they emerge out on an upper side of said transverse disk plate, and wherein said interface membrane further comprises a hydrophobic membrane surface that is selectively permeable to air in the presence of liquid and is located in the vicinity of said plate.

23. A bottle according to claim 22, wherein said filtering device comprises at least one hydrophobic tubular filter for air intake having walls made of a hydrophobic membrane material selectively permeable to air in the presence of liquid that form said hydrophobic membrane surface, and wherein said at least one hydrophobic tubular filter for air intake emerges out through same said transverse disk plate as said hydrophilic tubular filters for liquid expulsion on said upper side of said transverse disk plate.

24. A bottle according to claim 23, wherein said filtering device further comprises a non-perforated sheath encasing a bundle of said hydrophilic tubular filters for liquid expulsion, said at least one hydrophobic tubular filter for air-intake being outside said sheath.

25. A bottle according to claim 22, wherein said filtering device comprises hydrophobic tubular filters for air intake with walls made of a hydrophobic membrane material selectively permeable to air in the presence of liquid that form said hydrophobic membrane surface, said hydrophobic tubular filters being disposed surrounding a bundle of said hydrophilic tubular filters in the vicinity of said transverse disk plate.

* * * * *